US005941046A

United States Patent [19]

Prather

[11] Patent Number: 5,941,046

[45] Date of Patent: Aug. 24, 1999

[54] TRIM MOLDING AND METHOD OF INSTALLING SAID TRIM MOLDING

[76] Inventor: Willard I. Prather, 806 120th Ave., Knoxville, Iowa 50138

[21] Appl. No.: 08/851,247

[22] Filed: May 5, 1997

[51] Int. Cl.[6] ..... E04C 2/38

[52] U.S. Cl. ..... 52/717.01; 52/208; 52/211; 52/212; 52/288.1; 52/718.01; 52/718.04; 52/718.05; 52/741.1

[58] Field of Search ..... 52/211, 213, 217, 52/212, 204.53, 204.55, 208, 716.1, 716.4, 718.04, 718.05, 242, 282.1, 318, 127, 282.3, 287.1, 288.1, 717.01, 718.01, 741.1; 248/286.1, 285.1, 314, 228.2

[56] References Cited

U.S. PATENT DOCUMENTS 5,651,224 7/1997 Brabant ..... 52/718.04 X 5,752,356 5/1998 Miklavic et al. ..... 52/718.02

*Primary Examiner*—Christopher Kent

*Attorney, Agent, or Firm*—Henderson & Sturm

[57] ABSTRACT

Trim molding for use around windows, doors, the base of walls and wall-ceiling interfaces is constructed so that it may be installed without the use of fasteners nailed through the outside face of the trim molding. Receptacles are formed in the back side of the trim molding in the shape of a T-slot for receivable and slidably engaging an enlarged connector head previously inserted into the mounting surface. The back surface of the T-slot receptacle is beveled thereby creating a wedge which engages the enlarged connector head securing the trim against the mounting surface. The trim molding is easily removable when it is desired to repaint, wallpaper, or install a different flooring material, thereby eliminating the need to work around the trim molding or having to mask or tape the trim when preparing to paint.

10 Claims, 4 Drawing Sheets

TRIM MOLDING AND METHOD OF INSTALLING SAID TRIM MOLDING

CROSS-REFERENCE TO RELATED APPLICATIONS

Not applicable.

STATEMENT REGARDING FEDERALLY SPONSORED RESEARCH OR DEVELOPMENT

Not applicable.

MICROFICHE APPENDIX

Not applicable.

BACKGROUND OF THE INVENTION

1. Field of the Invention

The present invention relates generally to trim molding and more particularly to trim molding used around doors, windows, the base of walls and wall/ceiling interfaces and also particularly relates to methods of installing said trim molding.

2. Description of Prior Art

Installation of trim molding as part of the finish carpentry phase of building projects has become increasingly more costly from the standpoint of labor and time required for the many steps involved installing the trim molding. For example, when installing conventional wood trim molding around doors, windows, the base of walls and wall/ceiling interfaces, the trim must be cut to length and properly mitered at the ends, after which the trim must be nailed in place. Once the trim is nailed in place, the nail heads must be set below the surface of the wood with a nail punch. The nail holes must then be filled with wood putty, and finally the trim must be painted or stained and varnished. If the step of staining and varnishing the trim is performed before the trim is nailed in place, a colored wood putty that somewhat matches the color of the stain must be used to fill the nail holes.

Conventional trim molding, once installed is difficult to remove without damaging the trim or the wall surface to which it is attached. Therefore, the trim usually remains in place over the life of the building when it is desired to repaint, wallpaper, or install a different floor surface. To prevent paint from dripping onto the trim or to prevent accidental painting of the trim while brushing or rolling the paint on the wall, most painters will tape or mask the trim to prevent such occurrences. When wall papering, the wall paper must be carefully cut around the trim. Further, wood trim molding often contracts after installation as the wood dries or expands and contracts with changing temperatures creating unsightly gaps along the wall and at the mitered joints thereby detracting from an otherwise neat appearance.

Consequently, there is a need in the finish carpentry industry to reduce the time and labor involved in installing trim molding, and eliminate the need for nails and filling of nail holes. There is a further need to enable the trim to be easily adjustable to eliminate the unsightly gaps that often occur at the walls and mitered joints as the wood expands and contracts, and also to there is a need to have trim molding that is easily removable when it is desired to repaint, wallpaper or install a different floor surface.

BRIEF SUMMARY OF THE INVENTION

The present invention relates to a trim molding for use around windows, doors, the base of walls and wall/ceiling interfaces that may be installed without the use of fasteners nailed through the outside face of the trim molding. The trim molding is easily removable when it is desired to repaint, wallpaper, or install a different flooring material, thereby eliminating the need to work around the trim molding of having to mask or tape the trim when preparing to paint. The back side of the trim molding has receptacles at predetermined spacings formed therein for receivably and slidably engaging a connector. The connector has an enlarged connector head and a narrower neck portion projecting a predetermined distance outwardly from a mounting surface.

The receptacles include a slot having flanges projecting inwardly toward each other thereby creating a T-shape when viewed in cross-section. The slot begins at or near one edge of the trim molding and extends to and terminates at a distance below a second edge of the trim molding. The slot is of a predetermined width for receiving the enlarged connector head. The inwardly projecting flanges of the slot create an opening through which the narrow neck portion of the connector may extend but not the enlarged connector head. The slot has a beveled back surface, thereby creating a wedge or cam surface for slidably engaging the enlarged connector head against the trim molding. The trim molding is therefore pulled toward the mounting surface as it is pushed over the connector.

Therefore, it is an object of the present invention to be able to install trim molding without pounding nails through the trim, thereby eliminating the need to set the nails with a nail punch and then fill the holes with putty.

It is another object of the present invention to enable the trim molding to be installed after it is painted or stained and varnished without damaging the finish during installation. The trim could therefore be pre-finished in a controlled environment resulting in a more uniform finish at lower costs.

It is still a further object of the present invention to reduce the time and labor required for installation of trim molding, thereby lowering contractor costs.

It is still a further object of the present invention to enable the trim molding to be easily removed when desired for painting, wallpapering or installing a different flooring surface during the life of the building.

Other objects, advantages, and novel features of the present invention will become apparent from the following detailed description of the invention when considered in conjunction with the accompanying drawings.

DETAILED DESCRIPTION OF THE INVENTION

Figure 1:
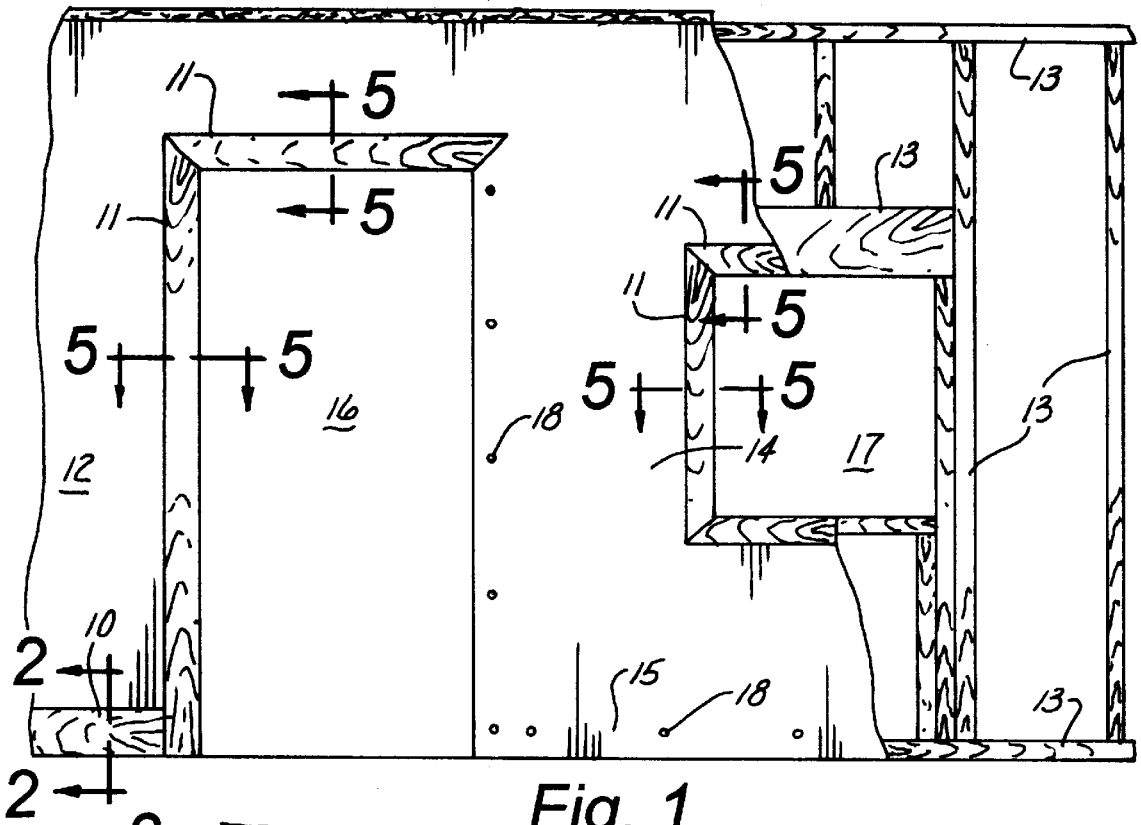
FIG. 1 shows trim molding of the present invention partially installed around a door opening a window opening and around the base of a wall.

Referring now to the drawings wherein like reference numerals designate identical or corresponding parts throughout the several views, FIG. 1 shows a typical mounting surface (12) for the trim molding (10 and 11) of the present invention. In most new and existing homes the mounting surface (12) for the trim molding (10 and 11) will be a wall constructed of wood or timber framing (13) to which drywall panels (14) are attached. FIG. 1 shows the base trim molding (10) partially installed at the base of the wall (15) and door and window trim molding (11) partially installed around a door opening (16), and around a window opening (17). Connectors (18), having an enlarged head portion (20) and a narrower neck portion (21), are shown installed at predetermined locations around the perimeter of the door opening (16) and base of the wall (15) where the trim (10 and 11) has not yet been installed.

Figure 2:
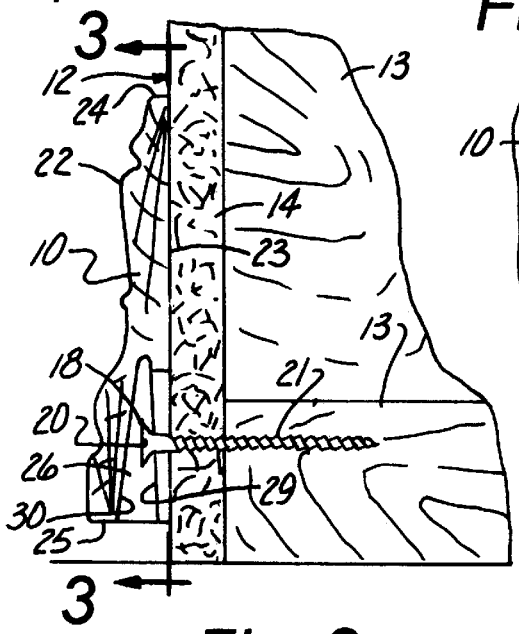
FIG. 2 is a cross-sectional view of the wall mounting surface and base trim molding of the present invention taken along lines 2—2 of FIG. 1.
Figure 5:
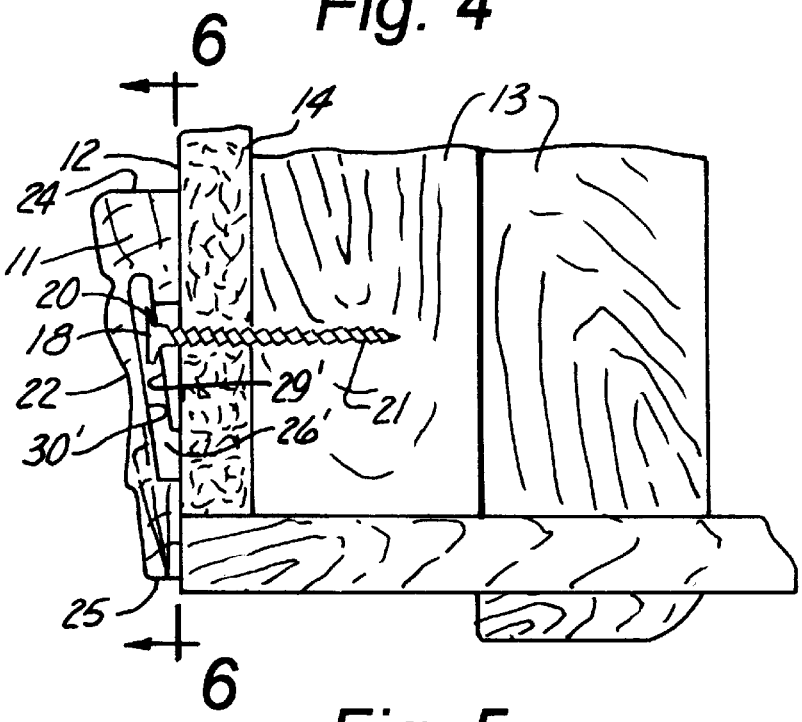
FIG. 5 is a cross-sectional view of the door or window opening and trim molding of the present invention taken along lines 5—5 of FIG. 1.

In the preferred embodiment, the connectors (18) are drywall screws. Fine, rather than course threaded drywall screws are preferred because the amount of projection of the connector (18) from the mounting surface (12) is easier to adjust, however, either fine or coarse threaded connectors will work. The connectors (18) are shown partially inserted through the drywall (14) and into the wood framing (13). As best illustrated in FIGS. 2 and 5, which are cross-sectional views taken along lines 2—2 and 5—5 of FIG. 1 respectively, the enlarged connector head (20) and a portion of the neck (21) of the connectors (18) are left projecting out from the face of the mounting surface (12) a predetermined distance (preferably ¼ inch). The amount of projection of the connectors (18) is easily adjustable if drywall screws and a drywall screw gun are used. It should be noted that drywall screws are not the only connector that may be used for mounting the trim molding to a mounting surface. Any connector having an enlarged head and thinner neck portion may be used, such as a headed nail, bolt or wood screw.

Figure 3:
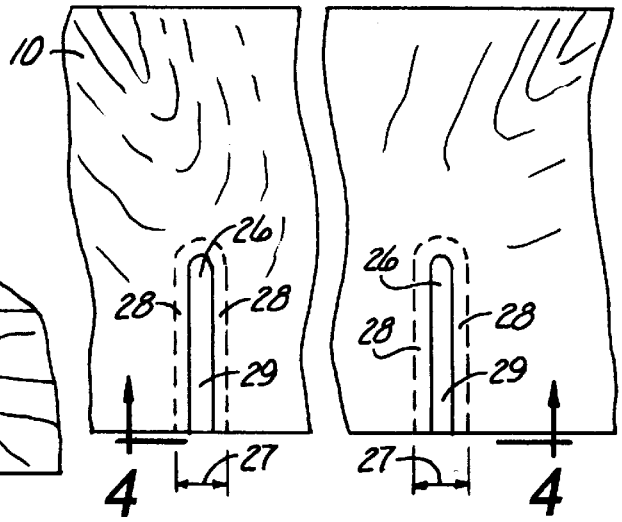
FIG. 3 is a rear view of the base trim molding of the present invention as viewed along lines 3—3 of FIG. 2.
Figure 4:
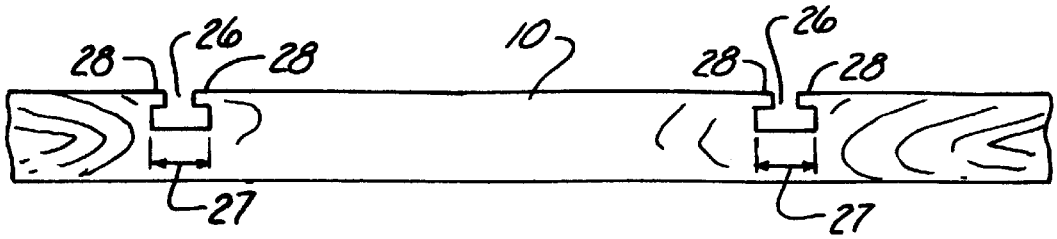
FIG. 4 is a bottom view of the base trim molding of the present invention as viewed along lines 4—4 of FIG. 3.

In FIG. 2, the base trim (10) is shown in vertical cross-section, and includes a front side (22), a back side (23), a first edge (24), and a second edge (25). A receptacle (26) is also shown in vertical cross-section formed therein. A rear view of the base trim molding (10) as viewed along lines 3—3 of FIG. 2 is shown in FIG. 3, and a bottom view of the base trim molding (10) as viewed along lines 4—4 of FIG. 3 is shown in FIG. 4. As can be seen, the receptacle (26) is in the shape of a "T" slot, beginning at the second edge (25) and extending upward toward the first end (24) of the base trim (10) approximately 1½ inches. The base (27) of the T-slot receptacle (26) must be of sufficient width (usually ⅜ inch) to receive the enlarged connector head (20). The inwardly projecting flanges (28) of the T-slot receptacle (26) form a space therebetween of sufficient width (preferably ¼ inch) for the neck (21) of the connector (18) to pass between, but narrow enough that the enlarged connector head (20) cannot pass between. Referring back to FIG. 2 showing the base trim molding (10) in vertical cross-section, it should be noticed that the back surface (29) of the receptacle (26) is beveled, the thinner end beginning at the second edge (25) of the base trim (10). The front surface (30) of the receptacle (26) is parallel to the front face (22). The beveled back surface (29) of the receptacle (26) is easily created with a typical router using a ⅜ inch T-shaped router bit. The purpose of having the beveled back surface (39) is to act as a wedge. The farther the base trim molding (10) is pushed over the connector (18) the more secure the base trim molding (10) will fit against the mounting surface (12).

FIG. 5 shows the trim molding (11), in cross-section installed around a door opening (16) or window opening (17). The door and window trim molding (11), like the base trim molding (10), includes a front side (22), a back side (23), a first edge (24), and a second edge (25). The installation of the door and window trim molding (11) is similar to the installation of the base trim molding (10), except that the door and window trim molding (11) requires a receptacle (26') that is not visible from the first edge (24) or second edge (25) of the trim (11) because both edges (24 and 25) will be exposed.

Figure 6:
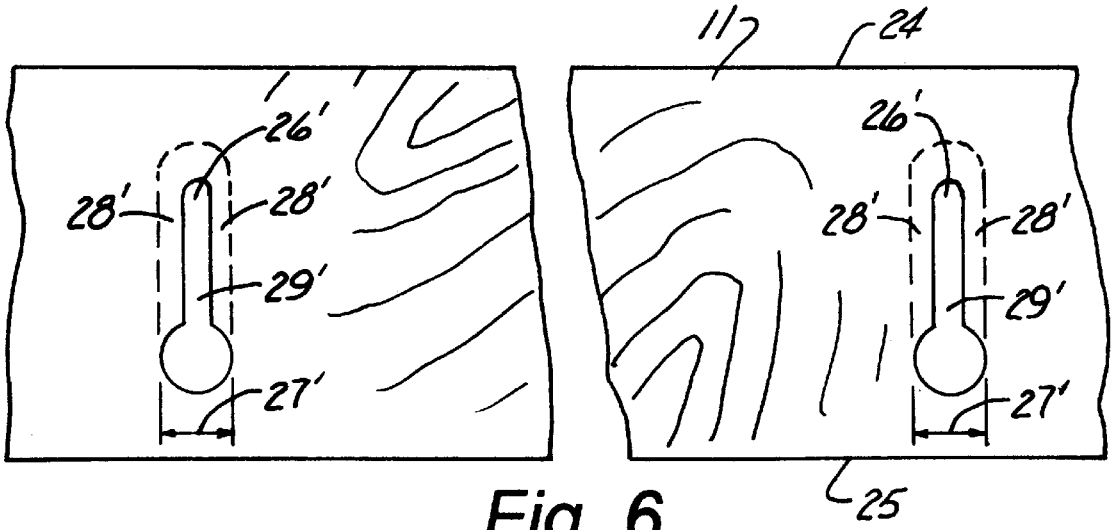
FIG. 6 is a rear view of the door or window trim molding of the present invention as viewed along lines 6—6 of FIG. 5.

A rear view of the trim molding (11) as viewed along lines 6—6 of FIG. 5 is shown in FIG. 6. As can be seen, the receptacle (26') is also in the shape of a "T" slot. However rather than beginning at the second edge (25), as in the base trim molding (10), the receptacle (26') begins a distance above the second edge (25) (preferably ⅝ inch), and extends upward toward the first edge (24) of the base trim (10) approximately 1½ inches. As before, the base (27') of the T-slot receptacle (26') must be of sufficient width (usually ⅜ inch) to receive the enlarged connector head (20). The inwardly projecting flanges (28') of the T-slot receptacle (26') must form a space therebetween of sufficient width (preferably ¼ inch) for the neck (21) of the connector (18) to pass between, but narrow enough that the enlarged connector head (20) cannot pass between. Referring back to FIG. 5, showing the door or window trim molding (11) in vertical cross-section, it should be noticed that the back surface (29') of the receptacle (26') is beveled, the thinner end beginning toward the second edge (25) of the trim (11). The front surface (30') of the receptacle (26') is parallel to the front face (22). The beveled back surface (29') of the receptacle (26') is easily created with a typical router using a ⅜ inch T-shaped router bit. The purpose of having the beveled back surface (29') is to act as a wedge. The farther the trim molding (11) is pushed over the connector (18) the more secure the trim molding (11) will fit against the mounting surface (12).

FIGS. 7 through 12 show alternative embodiments which may be used when the trim molding (10 or 11) is made from softer woods such as pine. When softer woods are used for the trim molding (10 or 11), the flanges (28 or 28') of the T-shaped receptacle (26 or 26') may not be strong enough to secure the trim molding (10 or 11) against the enlarged connector head (20), or the flanges (28 or 28') may splinter away when the receptacle (26 or 26') is being formed in the trim molding (10 or 11) by a router. To avoid these problems, a wider T-shaped receptacle (26") having wider flanges (28") must be formed in the trim molding (10 or 11) and a plate (40), made from hard plastic material or metal, must be used to abut against the enlarged connector head (20).

Figure 7:
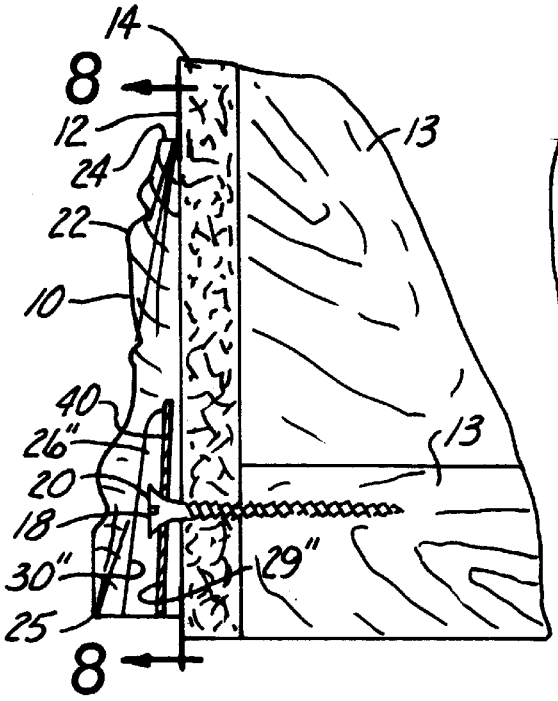
FIG. 7 shows an alternative embodiment of the base trim molding of FIG. 2.
Figure 8:
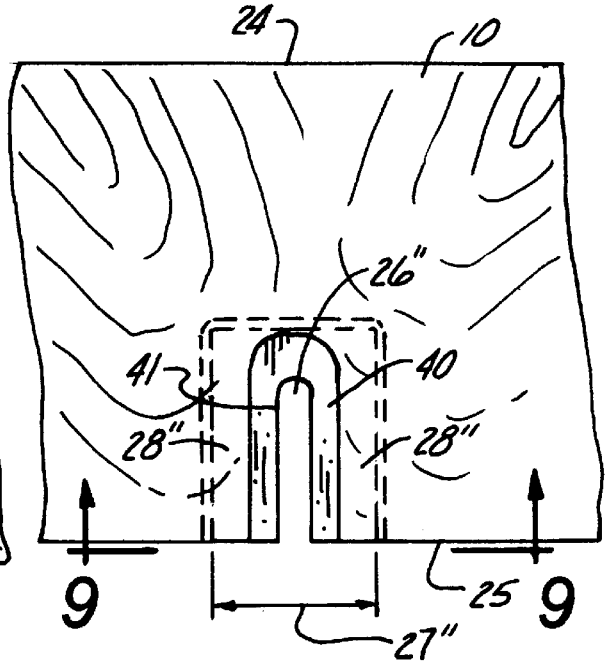
FIG. 8 is a rear view of the base trim molding of FIG. 7 as viewed along lines 8—8 of FIG. 7.
Figure 9:
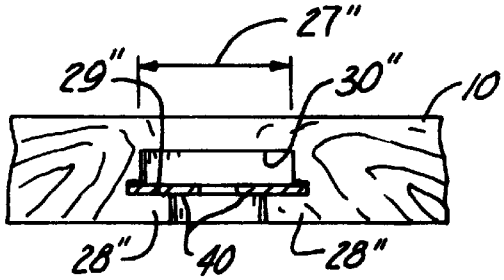
FIG. 9 is a bottom view of the base trim molding of FIG. 7 as viewed along lines 9—9 of FIG. 8.

FIG. 7 is the same as FIG. 2 except that a plate (40) is being used along the beveled back surface (29") to abut against the enlarged connector head (20). FIG. 8 is a rear view of the trim molding (10) as viewed along lines 8—8 of FIG. 7, and FIG. 9 is a bottom view of the trim molding (10) as viewed along lines 9—9 of FIG. 8. An enlarged T-shaped receptacle (26") is formed in the back side (23) of the trim (10). The receptacle (26") is in the shape of a "T" slot, beginning at the second edge (25) and extending upward toward the first edge (24) of the base trim (10) approximately 1½ inches. The base (27") of the T-slot receptacle (26") must be of sufficient width (preferably 1 inch) to receive the plate (40). The inwardly projecting flanges (28") of the T-slot receptacle (26") form a space therebetween and act as a ledge for the plate (40). The plate (40) includes an elongated slot (41) of sufficient width (preferably ¼ inch) for the neck (21) of the connector (18) to pass between, but narrow enough that the enlarged connector head (20) cannot pass between. Referring back to FIG. 7 showing the base trim molding (10) in vertical cross-section, it should be noticed that the back surface (29") of the receptacle (26") is beveled, the thinner end beginning at the second edge (25) of the base trim (10). The front surface (30") of the receptacle (26) is parallel to the front face (22). The beveled back surface (29") of the receptacle (26") is easily created with a typical router using a T-shaped router bit. The purpose of having the beveled back surface (29") is to act as a wedge. The farther the base trim molding (10) is pushed over the connector (18) the more secure the base trim molding (10) will fit against the mounting surface (12).

Figure 10:
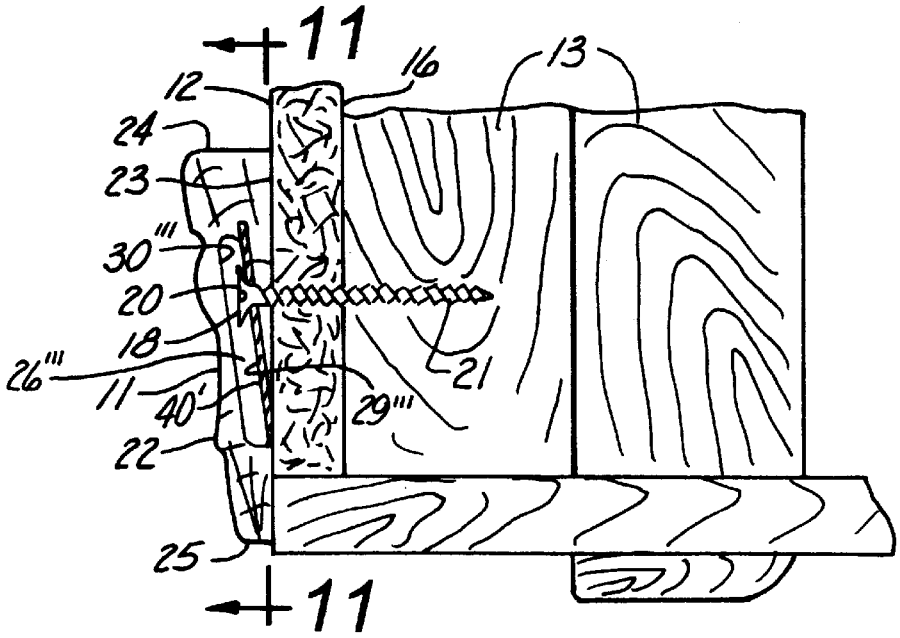
FIG. 10 shows an alternative embodiment of the door and window trim molding of FIG. 5.
Figure 12:
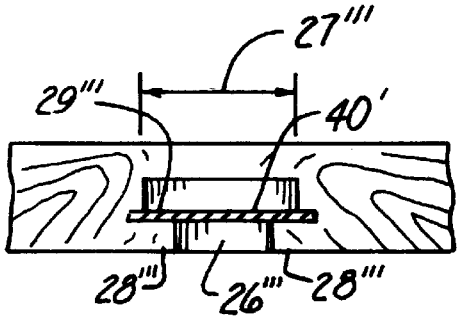
FIG. 12 is a cross-sectional view of the door and window trim molding of FIG. 10 taken along lines 12—12 of FIG. 11.
Figure 11:
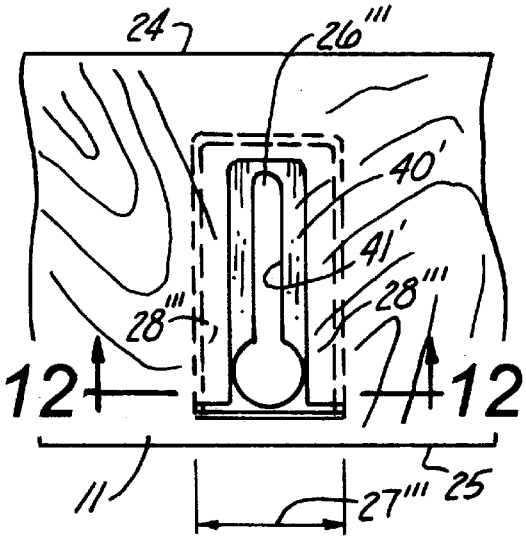
FIG. 11 is a rear view of the door and window trim molding of FIG. 10 as viewed along lines 11—11 of FIG. 10.
Figure 13:
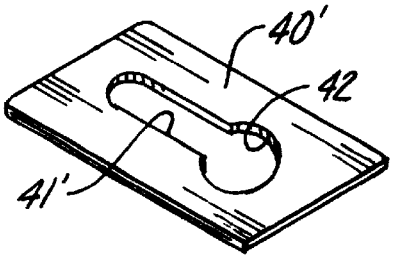
FIG. 13 is shows the plate used for insertion into the T-slot receptacle of the door and window trim molding of FIG. 10.

FIG. 10 is the same as FIG. 5 except that a plate (40') is being used along the beveled back surface (29''') to abut against the enlarged connector head (20). FIG. 11 is a rear view of the door and window trim molding (11) as viewed along lines 11—11 of FIG. 10. Similar to the embodiment of FIG. 5, FIG. 10 shows the receptacle (26''') beginning a distance above the second edge (25) (preferably ⅝ inch), and extends upward toward the first edge (24) of the trim (11) approximately 1½ inches. The base (27''') of the T-slot receptacle (26') must be of sufficient width (preferably 1 inch) to receive the plate (40'). The inwardly projecting flanges (28''') of the T-slot receptacle (26''') form a space therebetween and act as a ledge for the plate (40') best viewed in FIG. 12 which is a cross-sectional view of the trim molding (11) taken along lines 12—12 of FIG. 11. As shown in FIG. 13, the plate (40') includes an elongated slot (41') terminating with a large diameter aperture (42). The elongated slot (41') must be of sufficient width (preferably ¼ inch) for the neck (21) of the connector (18) to pass between, but narrow enough that the enlarged connector head (20) cannot pass between. The aperture (42) must be large enough in diameter to receive the enlarged connector head (20). Referring back to FIG. 10 showing the trim molding (11) in vertical cross-section, it should be noticed that the back surface (29''') of the receptacle (26''') is beveled, the thinner end beginning toward the second edge (25) of the trim (11). The front surface (30''') of the receptacle (26''') is parallel to the front face (22). The beveled back surface (29''') of the receptacle (26''') is easily created with a typical router using a T-shaped router bit. The purpose of having the beveled back surface (29''') is to act as a wedge. The farther the trim molding (11) is pushed over the connector (18) the more secure the trim molding (11) will fit against the mounting surface (12).

Obviously many modifications and variations of the present invention are possible in light of the above teachings. It is therefore to be understood that, within the scope of the appended claims, the invention may be practiced otherwise than as specifically described.

I claim:

1. Trim molding adapted for use around wall openings, the base of walls and wall-ceiling interfaces comprising:

trim molding having a front side and a back side, a first edge and a second edge; and wherein said back side of said trim molding has receptacles at predetermined spacings formed in substantially one piece with said trim molding for receivably and slidably engaging a connector as the trim molding is moved in a direction from the first edge toward the second edge, said connector having an enlarged connector head and narrower neck portion projecting a predetermined distance outwardly from a mounting surface.

2. The trim molding of claim 1 wherein said receptacles include a slot disposed transverse to a longitudinal axis of the trim mold having flanges projecting inwardly toward each other thereby creating a T-shape when viewed in cross-section;

said slot beginning at said second edge of said trim molding and extending to and terminating at a distance below said first edge of said trim molding;

said slot being of a predetermined width for receiving said enlarged connector head;

said inwardly projecting flanges of said slot creating an opening therebetween in which said narrow neck portion of said connector may extend between but being narrow enough to prevent said enlarged connector head from passing between; and said slot having a beveled back surface, thereby creating a wedge for slidably engaging said enlarged connector head against said trim molding thereby securing said trim molding to said mounting surface.

3. The trim molding of claim 1 wherein said receptacles include a slot having flanges projecting inwardly toward each other thereby creating a T-shape when viewed in cross-section;

said slot beginning a predetermined distance above said second edge of said trim molding and extending to and terminating at a distance below said first edge of said trim molding;

said slot being of a predetermined width for receiving said enlarged connector head;

said inwardly projecting flanges of said slot creating an opening therebetween in which said narrow neck portion of said connector may extend between but being narrow enough to prevent said enlarged connector head from passing between; and said slot having a beveled back surface, thereby creating a wedge for slidably engaging said enlarged connector head against said trim molding thereby securing said trim molding to said mounting surface.

4. The trim molding of claim 1 wherein said receptacles include a slot having flanges projecting inwardly toward each other thereby creating a T-shape when viewed in cross-section;

said slot beginning at said second edge of said trim molding and extending to and terminating at a distance below said first edge of said trim molding;

said slot being of a predetermined width for receiving a plate;

said inwardly projecting flanges of said slot acting as a ledge for said plate;

said plate having an elongated opening in which said narrow neck portion of said connector may extend between but being narrow enough to prevent said enlarged connector head from passing between; and said slot having a beveled back surface, thereby creating a wedge for slidably engaging said enlarged connector head against said trim molding thereby securing said trim molding to said mounting surface.

5. The trim molding of claim 1 wherein said receptacles include a slot having flanges projecting inwardly toward each other thereby creating a T-shape when viewed in cross-section;

said slot beginning a predetermined distance above said second edge of said trim molding and extending to and terminating at a distance below said first edge of said trim molding;

said slot being of a predetermined width for receiving a plate;

said inwardly projecting flanges of said slot acting as a ledge for said plate;

said narrow neck portion of said connector may extend between but being narrow enough to prevent said enlarged connector head from passing between; and said slot having a beveled back surface, thereby creating a wedge for slidably engaging said enlarged connector head against said trim molding thereby securing said trim molding to said mounting surface.

6. The trim molding of claim 1, wherein said trim molding comprises wood.

7. A method of installing trim molding against a mounting surface comprising the steps of:

inserting a plurality of connectors having an enlarged head and narrower neck portion at predetermined spacings partially into a mounting surface, thereby leaving a portion of said neck and enlarged connector head projecting outwardly from the mounting surface;

cutting said trim molding into predetermined lengths, said trim having a front side and a back side and a first edge and a second edge;

forming receptacles on said back side of said trim molding which have a beveled back surface with portions of the beveled back surface being nearer the first edge than the second edge, said receptacles being positioned to align with said projecting connectors and having a shape for receiving and slidably engaging said enlarged connector heads; and positioning said trim molding with said receptacles over said enlarged connector heads and slidably moving the trim molding in a direction from the first edge toward the second edge for engaging said trim molding over said enlarged connector heads until said trim molding is firmly secured to said mounting surface while at the same time the trim molding moves closer to the mounting surface due to the beveled back surface.

8. The method of claim 7, wherein said trim molding comprises wood.

9. A trim molding apparatus comprising:

a mounting surface;

a plurality of connectors disposed at spaced apart locations along the mounting surface, said connectors each having a head portion which is larger than intermediate neck portions;

trim molding having a front side and a back side, a first edge and a second edge; and receptacles disposed in said trim molding receiving and holding respective connectors, said receptacles including a beveled back surface, portions of said beveled back surface nearer the second edge being closer to the back side of the trim molding than portions of the beveled back surface which are closer to the first edge thereof whereby when the head of the connectors are disposed within respective receptacles between the first edge and the second edge and the trim is pushed in a direction from the first edge toward the second edge, the head portions of the connectors will pull the trim molding tightly against the mounting surface.

10. The trim molding of claim 9, wherein said trim molding comprises wood.

* * * * *